United States Patent [19]

Eilers et al.

[11] 4,305,462

[45] Dec. 15, 1981

[54] APPARATUS FOR POSITIONING DEFLECTION WEDGES

[75] Inventors: Wulf Eilers, Johannesburg; Zdenek L. Figar, Krugersdorp; Johan G. Grabe, Carletonville; Stanley J. Landers, Bryanston; David S. Williams, Springs,all of South Africa

[73] Assignee: Boart International Limited, Johannesburg, South Africa

[21] Appl. No.: 12,904

[22] Filed: Feb. 16, 1979

[30] Foreign Application Priority Data

Feb. 16, 1978 [ZA] South Africa ..... 78/0917

[51] Int. Cl.[3] ..... E21B 7/08; E21B 23/12

[52] U.S. Cl. ..... 166/117.6; 175/61; 175/83

[58] Field of Search ..... 166/117.6, 315; 175/61, 175/62, 80, 1, 83

[56] References Cited

U.S. PATENT DOCUMENTS

| | | | |
|---|---|---|---|
| 2,147,585 | 2/1939 | Trotter | 175/83 |
| 2,207,920 | 7/1940 | Hughes | 175/82 X |
| 2,691,507 | 10/1954 | Brown | 175/82 X |
| 3,011,568 | 12/1961 | Grimm | 166/117.6 X |

*Primary Examiner*—James A. Leppink
*Assistant Examiner*—George A. Suchfield
*Attorney, Agent, or Firm*—Cushman, Darby & Cushman

[57] ABSTRACT

A deflection wedge is positioned in a long horizontal drill hole by securing it with a shear pin to an extension on a drill string. The extension is turned independently of the drill string to enable a droparm mechanism to actuate a trigger which stops rotation at a predetermined orientation. Rotation is effected by means of a rifle bar mechanism. The rifle bar presses against the bottom of the hole to cause rotation and the trigger declutches the rifle nut when the droparm drops.

2 Claims, 8 Drawing Figures

APPARATUS FOR POSITIONING DEFLECTION WEDGES

BACKGROUND OF THE INVENTION

This invention relates to the positioning of deflection wedges in drill holes which are horizontal or have a pronounced horizontal component.

Deflection wedges for vertical holes are well known and consist essentially of frusto-conical segments which are wedged in position in a drill hole. When next a drill bit is inserted in the hole, the wedge causes the bit to drill at an angle to the axis of the original hole. Deflection wedges are normally positioned at the end of a drill string, let down the hole, orientated to give the correct deflection and then severed from the drill string as by shearing a shear pin. The drill string is then removed leaving the wedge in position—see U.S. Pat. No. 2,950,900.

Devices suitable for deflecting vertical holes cannot be used without change in deflecting horizontal holes. Nowadays horizontal or near horizontal holes are used extensively in very deep mining for exploration.

In South Africa a device has been used on a small scale and with success in holes up to 500 m long. Beyond that length problems are encountered. Basically the mechanism relies on a weighted droparm the free end of which follows a cam. When as a result of rotation of the string the cam attains a position where there is a vertical cam path, the droparm falls and releases a trigger.

The trigger closes a valve which stops water flow through the drill string and causes a hydraulic pulse which can be detected at the drilling machine. This pulse indicates that the cam has attained the correct position, and as the wedge is orientated relatively to the cam, that the wedge is in the correct position. By pushing the drill string forward, the wedge is wedged in position and a pin is sheared to allow withdrawal of the drill string.

When the hole is near horizontal, the drill string rests on the bottom wall of the hole and is subject to a large amount of friction when one turns it to get the correct orientation. When the drill string is very long, the friction results in a wind-up of the drill string and the resulting stored energy when released causes the free end of the string, i.e. the orientation mechanism and wedge, to whip. This energy may be released as the drill string is pushed forward to secure the wedge and shear the pin with the result that the wedge loses its original correct orientation. Also if the droparm falls during the release of energy the wedge may continue to rotate after the hydraulic pulse, indicating correct orientation, has been transmitted to the drilling machine.

SUMMARY OF THE INVENTION

According to the invention a method of positioning a deflection wedge in a drill hole, which has a pronounced horizontal component, comprises the steps of:

passing the deflection wedge along the hole at the end of a drill string; when the deflection wedge is at the bottom of a hole, turning it relatively to the drill string until it reaches the correct orientation in the drill hole; then preventing further turning; wedging the deflection wedge in position by pressing axially on the drill string; and detaching the drill string from the deflection wedge by further pressure on the drill string.

Means for positioning the deflection wedge in such a drill hole, according to the invention, comprises:

an extension adapted to be secured at one end to the end of a drill string in such a manner that the extension is free to rotate relatively to the drill string;

a deflection wedge detachably carried at the other end of the extension;

means to cause the extension to rotate relatively to the drill string; and a wedge orientation mechanism adapted to stop rotation of the extension upon a present orientation being achieved.

In one form of the invention the wedge orientation mechanism is a droparm mechanism and there is a trigger which is actuated by the mechanism to declutch the rotation means.

The means to rotate the extension may comprise a rifle bar mechanism one element of which is adapted to be anchored against the bottom of a drill hole by axial pressure on the drill string and the second element of which is clutched to the extension so that the droparm actuates a trigger which declutches the second element from the extension.

The rifle bar mechanism in turn may comprise a rifle bar adapted to be anchored and a rifle nut clutched to the extension by a dog clutch and in which the droparm actuates a spring biased trigger which upon actuation declutches the dog clutch.

DESCRIPTION OF A PREFERRED EMBODIMENT

Figure 6:
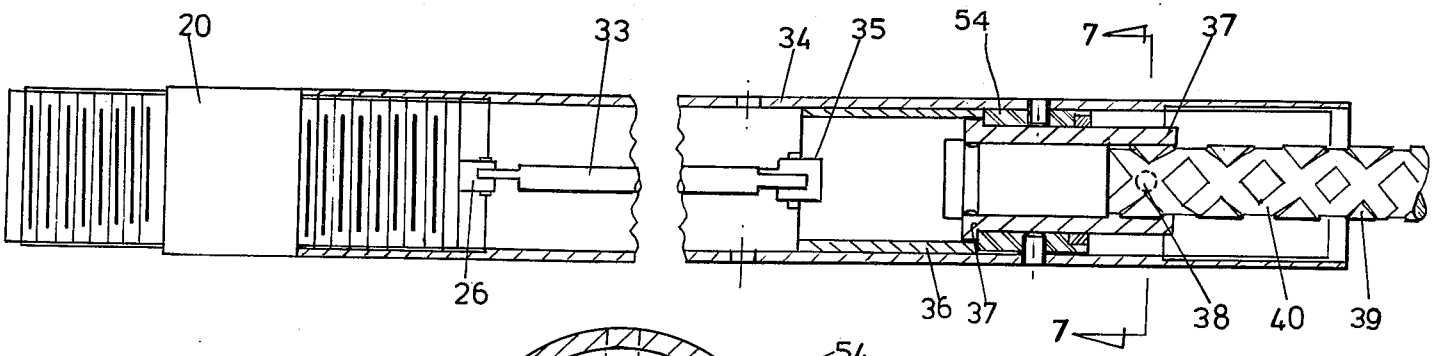
FIG. 6 is a longitudinal section of a further section of the extension.
Figures 3, 4, 5:
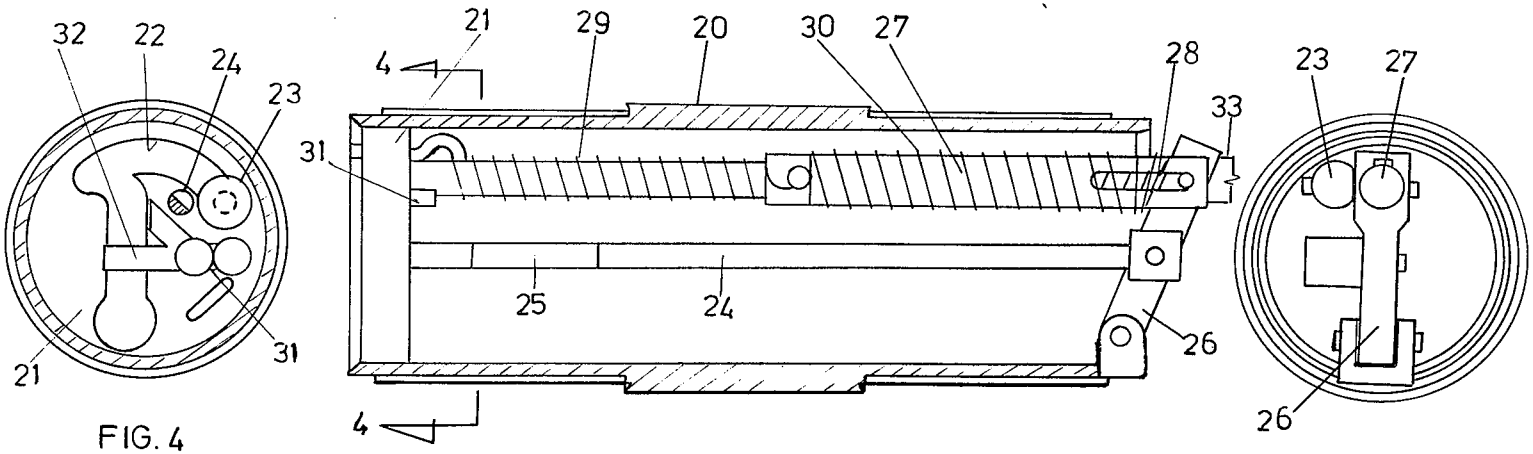
FIG. 3 is an enlarged section of part of FIG. 2.
FIG. 4 is a section on the line 4—4 in FIG. 3, rotated clockwise through 135°.
FIG. 5 is an end view of FIG. 3.
Figure 8:
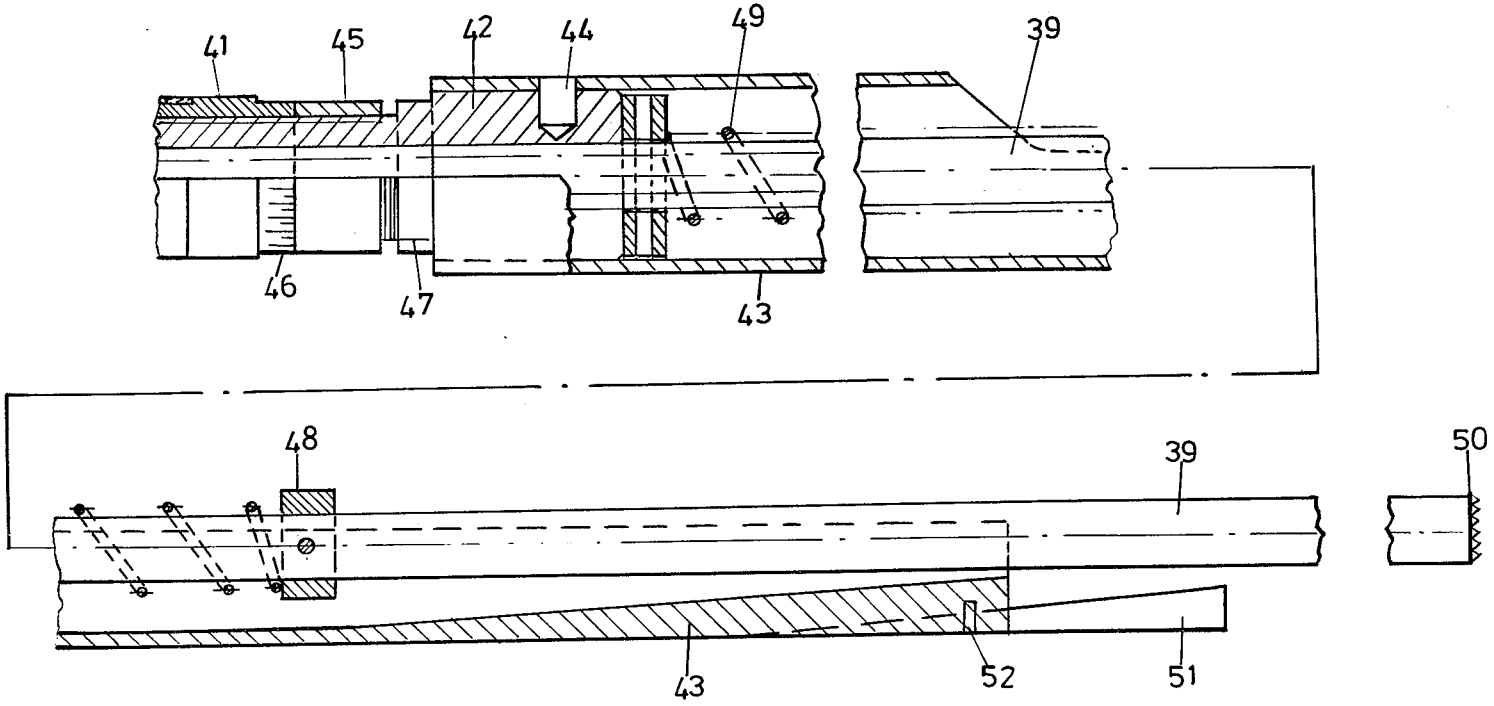
FIG. 8 is a longitudinal section of the end of the extension including the deflection wedge.

The embodiment illustrated is one long tubular element which is fitted as an extension to a drill string. In order to illustrate the embodiment properly, the various sections had to be shown in separate drawings. However, the extension is in effect FIG. 1 followed by FIG. 2 on its right, followed by FIG. 6, with FIG. 3 illustrating a common element 20, followed by FIG. 8.

Figure 1:
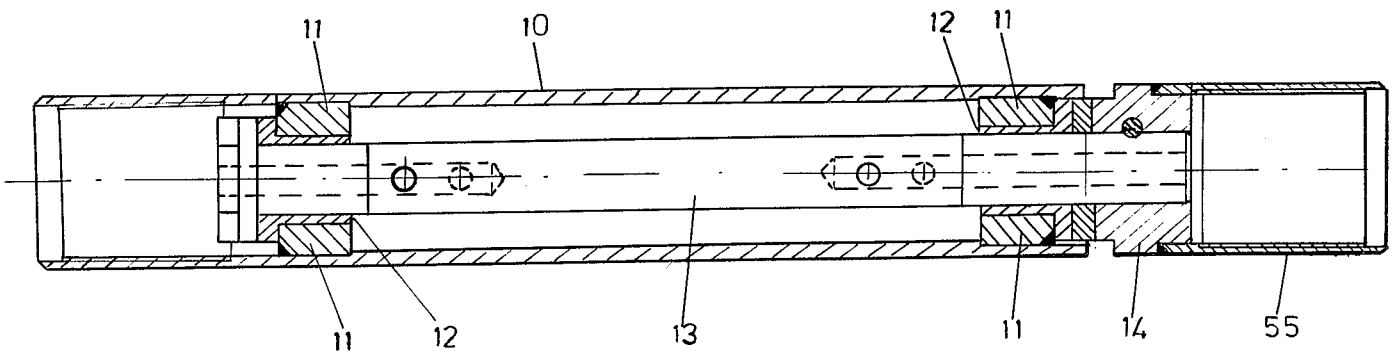
FIG. 1 is a longitudinal section through a coupling between a drill string and an extension of the invention.
Figure 2:
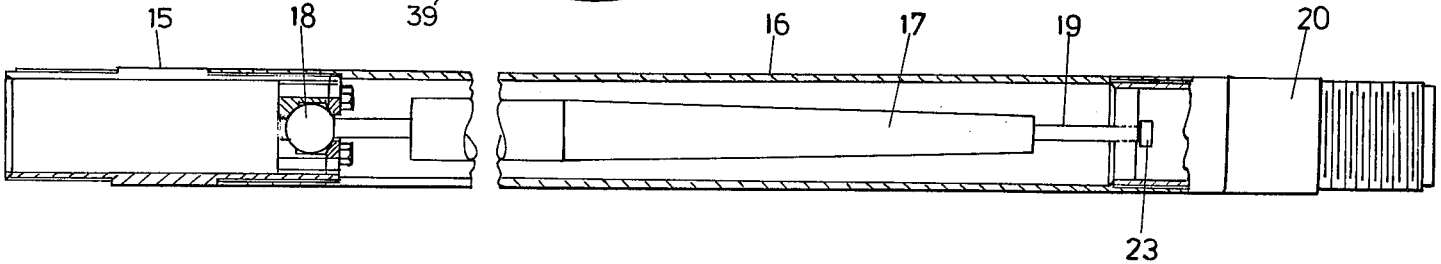
FIG. 2 is a longitudinal section of the section of the extension that carries the droparm, drawn to a smaller scale.

FIG. 1 illustrates a rotary coupling and comprises a sleeve 10 adapted to be secured to a drill string at its left and carrying rings 11 with bearing bushes 12. A shaft 13 is free to rotate in the bushes 12. The shaft 13 is fast with a holed boss 14 secured to an internally threaded sleeve 55.

The sleeve 10 is coupled to a coupling 15 (FIG. 2) which in turn is coupled to a droparm sleeve 16. In the sleeve 16 a droparm 17 is pivoted by means of a ball 18 operating in a socket fast with the coupling 15. The droparm 17 is thus free to rotate and swivel inside the sleeve 16. At its free end the droparm 17 has a head 19.

At the right hand end of the sleeve 16 there is a coupling 20 which houses very important parts of the mechanism. Note that the coupling 20 also appears in FIG. 6 to show the continuity of the device.

The coupling 20 is sectioned in the enlarged view of FIG. 3. At its left hand end it carries a cam plate 21 which appears in FIG. 4. The plate 21 has a cam groove 22 shaped as a distorted L as shown in FIG. 4. During operation it could have any orientation about the centre of its axis of rotation. The head 19 of the droparm 17 protrudes into the cam groove 22 and is formed with a cap 23. Initially the cap 23 is in the position illustrated in FIG. 4 and is prevented from moving in the groove 22 by a rod 24 which has a cutaway part 25. When the part 25 registers with the cap 23, the head can follow the groove 22 according to the dictates of gravity.

Pivoted in the coupling 20 is a lever 26 to which is pivoted the rod 24 and a composite rod 27 which has lost motion with the lever 26 by virtue of a slot 28. A tension spring 29 and a compression spring 30 act to bias the rod 27 to the left. The rod 27 is prevented from so moving by means of a catch 31 engaged in a notch on the rod 27. The catch 31 is carried by a trigger 32. In use the head 19 of the droparm 17 depresses the trigger 32 to allow the rod 27 to move and to pull the lever 26 over to the left.

Also pivoted to the lever 26 is a clutch bar 33 (FIG. 6) which extends through a sleeve 34 of some length for purposes to be described later on.

Figure 7:
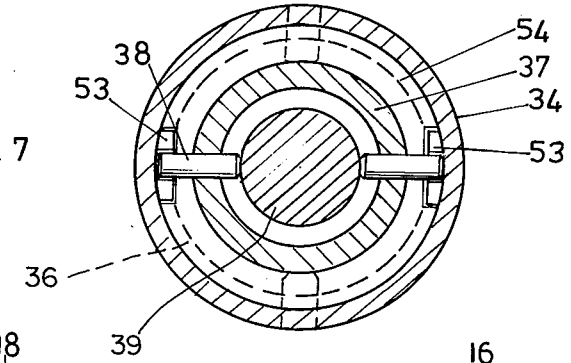
FIG. 7 is a section on the line 7—7 in FIG. 6.

At its other end the clutch bar 33 is pivoted to a crossbar 35 on a clutch sleeve 36. Fixed to the sleeve 34 is a bush 54 inside which fits an annular head cylinder 37. The cylinder 37 is provided with two connecting pins 38 projecting inwardly and outwardly. At their outer ends the pins 38 engage with slotted projections 53 (FIG. 7) of the sleeve 36 to constitute a dog clutch. As the sleeve 36 moves to the left the pins are disengaged, but as shown the springs 29 and 30 force the sleeve 36 to engage with the pins 38.

A translation bar 39 which is rifled at its left hand end by means of rifling 40 fits inside the cylinder 37 with the inner ends of the pins 38 engaged in the rifling 40.

The sleeve 34 is joined by means of a coupling 41 with a holed boss 42 to which the deflection wedge 43 is pinned by means of a shear pin 44. Between the coupling 41 and the boss 42 there is a lock nut 45. On the coupling 41 there are markings 46 say at 5° intervals and on the boss 42 there is a mark 47. Up to the coupling 41 the parts are assembled so that the orientation of the vertical part of the groove 22 is accurately known. By accurately adjusting the mark 47 relatively to the markings 46 the orientation of the wedge 43 can be preset and then fixed by means of the lock nut 45.

The translation bar 39 passes through the boss 42 and between the boss 42 and a collar 48 on the bar 39 there is a compression spring 49. At its right hand end the bar 39 is provided with spikes 50 or other formations for anchoring it to the bottom of a hole.

Finally the deflection wedge carries a locking wedge 51 which is secured to it by means of a shear pin 52.

In operation the extension composed of the sleeve 10, the boss 14, the coupling 15, the sleeve 16, the coupling 20, the sleeve 34, the coupling 41 and the deflection wedge 43 is secured to the end of a drill string with the wedge 43 correctly orientated relatively to the cam groove 22. The string is then passed along a hole.

As the spikes 50 engage with the bottom of the hole the bar 39 is held against rotation and the assembly passes axially over the bar 39. First the cap 23 is cleared for the head 19 to be able to move. Next the pins 38, which are engaged with the projections 53 on the sleeve 36, come into contact with the face of the bush 54 and the whole assembly rotates about the bar 39. When the head 19 drops down the vertical part of the cam groove 22, the trigger 32 is operated and the bar 33 withdraws the sleeve 36 so that the sleeve 34 is no longer clutched to the cylinder 37 which rotates freely inside the sleeve 34 as pressure on the drill string increases. The deflection wedge 43 thus remains in its orientated position. As pressure on the drill string increases, the pin 52 shears to force the wedge 43 over the wedge 51 to secure the wedge 43 in place. After further pressure the pin 44 shears. Now the drill string can be withdrawn leaving the deflection wedge 43 in place and correctly orientated.

Note that wind-up and subsequent whip in the drill string does not occur at all since the drill string itself is not rotated during positioning and locking of the wedge.

We claim:

1. Means for positioning a deflection wedge in a drill hole, which has a pronounced horizontal component of direction, comprising: an extension adapted to be secured at one end to the end of a drill string in such a manner that the extension is free to rotate relatively to the drill string; a deflection wedge detachably carried at the other end of the extension; means to cause the extension to rotate relatively to the drill string; and a wedge orientation mechanism including a droparm mechanism adapted to stop rotation of the extension upon a present orientation being achieved and a trigger actuated by the droparm mechanism to immobilize said rotation means, said rotation means including a rifle bar mechanism having a first element adapted to be anchored against the bottom of a drill hole by axial pressure on the drill string and a second element which is clutched to the extension so that the droparm mechanism actuates said trigger which declutches the second element from the extension.

2. The means claimed in claim 1 in which the rifle bar mechanism comprises a rifle bar adapted to be anchored and a rifle nut clutched to the extension by a dog clutch and in which the droparm actuates said trigger which is spring biased and which upon actuation declutches the dog clutch.

* * * * *